US009059518B2

(12) United States Patent
Mizoguchi et al.

(10) Patent No.: US 9,059,518 B2
(45) Date of Patent: Jun. 16, 2015

(54) ANTENNA FOR WIRELESS APPARATUS

(75) Inventors: Miyuki Mizoguchi, Obu (JP); Yuji Sugimoto, Kariya (JP); Tadao Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 174 days.

(21) Appl. No.: 13/997,849

(22) PCT Filed: Feb. 1, 2012

(86) PCT No.: PCT/JP2012/000656

§ 371 (c)(1),
(2), (4) Date: Jun. 25, 2013

(87) PCT Pub. No.: WO2012/108145

PCT Pub. Date: Aug. 16, 2012

(65) Prior Publication Data

US 2013/0307745 A1 Nov. 21, 2013

(30) Foreign Application Priority Data

Feb. 8, 2011 (JP) ..... 2011-25108

(51) Int. Cl.

| | |
|---|---|
| ***H01Q 1/38*** | (2006.01) |
| ***H01Q 21/12*** | (2006.01) |
| ***H01Q 1/48*** | (2006.01) |
| ***H01Q 1/52*** | (2006.01) |

(Continued)

(52) U.S. Cl.

CPC ..... *H01Q 21/12* (2013.01); *H01Q 1/48* (2013.01); *H01Q 1/52* (2013.01); *H01Q 9/0421* (2013.01); *H01Q 21/28* (2013.01)

(58) Field of Classification Search

CPC ..... H01Q 1/48; H01Q 21/12; H01Q 9/0421
USPC ..... 343/700 MS, 829, 844, 846
See application file for complete search history.

(56) References Cited

U.S. PATENT DOCUMENTS 2,424,968 A * 8/1947 Busignies ..... 343/814
3,530,473 A * 9/1970 Ives ..... 343/702

(Continued)

FOREIGN PATENT DOCUMENTS

JP 07-297631 A 11/1995
JP 2003-298340 A 10/2003

(Continued)

OTHER PUBLICATIONS

International Search Report and Written Opinion of the ISA for PCT/JP2012/000656, ISA/JP, mailed Apr. 24, 2012.

*Primary Examiner* — Tho G Phan
(74) *Attorney, Agent, or Firm* — Harness, Dickey & Pierce, PLC

(57) ABSTRACT

An antenna for wireless apparatus which is placed in the vicinity of a conductive object is disclosed. The antenna for wireless apparatus includes a GND plate, a conductive plate parallel to the GND plate, two antenna elements, and two raising conductive plates. Each of the antenna elements includes a short-circuit conductive body and a radiation plate placed at an edge of the short-circuit conductive body. The two antenna elements are placed substantially parallel to a side surface of the conductive object with a distance of a half wavelength of a radio wave to be transmitted and received. The two raising conductive plates are placed close to the two antenna elements respectively and raise the conductive plate from the GND plate to a predetermined height.

5 Claims, 6 Drawing Sheets

(51) Int. Cl.
*H01Q 9/04* (2006.01)
*H01Q 21/28* (2006.01)

(56) References Cited

U.S. PATENT DOCUMENTS 4,724,443 A * 2/1988 Nysen ..... 343/700 MS
5,648,787 A * 7/1997 Ogot et al. ..... 343/826
6,489,925 B2 * 12/2002 Thursby et al. ..... 343/700 MS
7,236,133 B2 * 6/2007 Ohara ..... 343/702
8,098,203 B2 * 1/2012 Ueki ..... 343/700 MS

FOREIGN PATENT DOCUMENTS

JP 2005-269228 A 9/2005
JP 2009-124577 A 6/2009

* cited by examiner

λ/1.9(≒27mm)

λ/2(≒25mm)

λ/2.2(≒23mm)

λ/2.4(≒21mm)

λ/2.7(≒19mm)

λ/3(≒17mm)

λ/3.4(≒15mm)

λ/3.9(≒13mm)

ANTENNA FOR WIRELESS APPARATUS

CROSS REFERENCE TO RELATED APPLICATIONS

This application is a 371 National Phase of PCT/JP2012/000656, filed on Feb. 1, 2012, based on Japanese Patent Application No. 2011-25108 filed on Feb. 8, 2011, the disclosures of which are incorporated herein by reference.

TECHNICAL FIELD

The present disclosure relates to an antenna for wireless apparatus which can successfully transmit and receive a radio wave in all round directions, especially, to an antenna for wireless apparatus suitable for use in a vehicle.

BACKGROUND ART

In an antenna for wireless apparatus in Patent Document 1, for example, a shield plate is used as a GND plate for shielding a transmission and receiving circuit for wireless apparatus. A radiating plate parallel to the GND plate is placed through a short-circuit conductive body. By the manner, an inverted-F antenna having the shield plate as the GND plate is configured, and a diversity antenna is configured by placing the multiple inverted-F antennas in different directions.

According to the antenna for wireless apparatus, by a directivity obtained from directivity synthesis of the multiple antennas, a substantially non-directional antenna can be realized.

PRIOR ART DOCUMENT

Patent Document

Patent Document 1: Japanese Unexamined Patent Publication No. 2003-298340. However, in the above antenna for wireless apparatus, when a metal object such as a metal structure or the like exists in parallel to a specific direction in the vicinity of an antenna, for example, exists in parallel to a direction of arrangement of the multiple antennas, the metal object functions as a reflector and causes a directivity bias of the antenna for wireless apparatus to result in deterioration of transmission and receiving efficiency.

SUMMARY OF THE INVENTION

In view of the above difficulties, it is an object of the present disclosure to provide an antenna for wireless apparatus which can successfully transmit and receive a radio wave in all round directions even when a conductive object is located in the vicinity of the antenna for wireless apparatus.

According to an example of the present disclosure, an antenna for wireless apparatus is provided, which is an antenna for wireless apparatus placed in the vicinity of a conductive object, including a GND plate, a conductive plate, two antenna elements and two raising conductive plates. The GND plate is a plate-shaped conductive body and its electric potential is kept at a GND level. The conductive plate is placed parallel to the GND plate. Each of the antenna elements is a monopole antenna element including a short-circuit conductive object, which is placed on the conductive plate to electrically connect with the conductive plate, and a radiation plate, which is placed at an edge of the short-circuit conductive object to radiate a radio wave. The two antenna elements are placed substantially parallel to a side surface of the conductive object at an interval of a half wavelength of the radio wave to be transmitted and received. The two raising conductive plates are placed between the GND plate and a former conductive plate, and respectively placed in vicinities of the two antenna elements to raise the conductive plate from the GND plate to a predetermined height.

According to the configuration, even when a conductive object is in the vicinity of the antenna for wireless apparatus, the antenna for wireless apparatus can successfully transmit and receive a radio wave in all round directions.

BRIEF DESCRIPTION OF THE DRAWINGS

The above and other aspects, features and advantages of the present disclosure will become more apparent from the following detailed description made with reference to the accompanying drawings. In the drawings.

PREFERRED EMBODIMENTS FOR CARRYING OUT THE INVENTION

Following, an example of an embodiment according to the present disclosure will be described with reference to drawings. The embodiment is not limited to below examples and can have various forms.

(Configuration of Antenna 1 for Wireless Apparatus)

Figure 1:
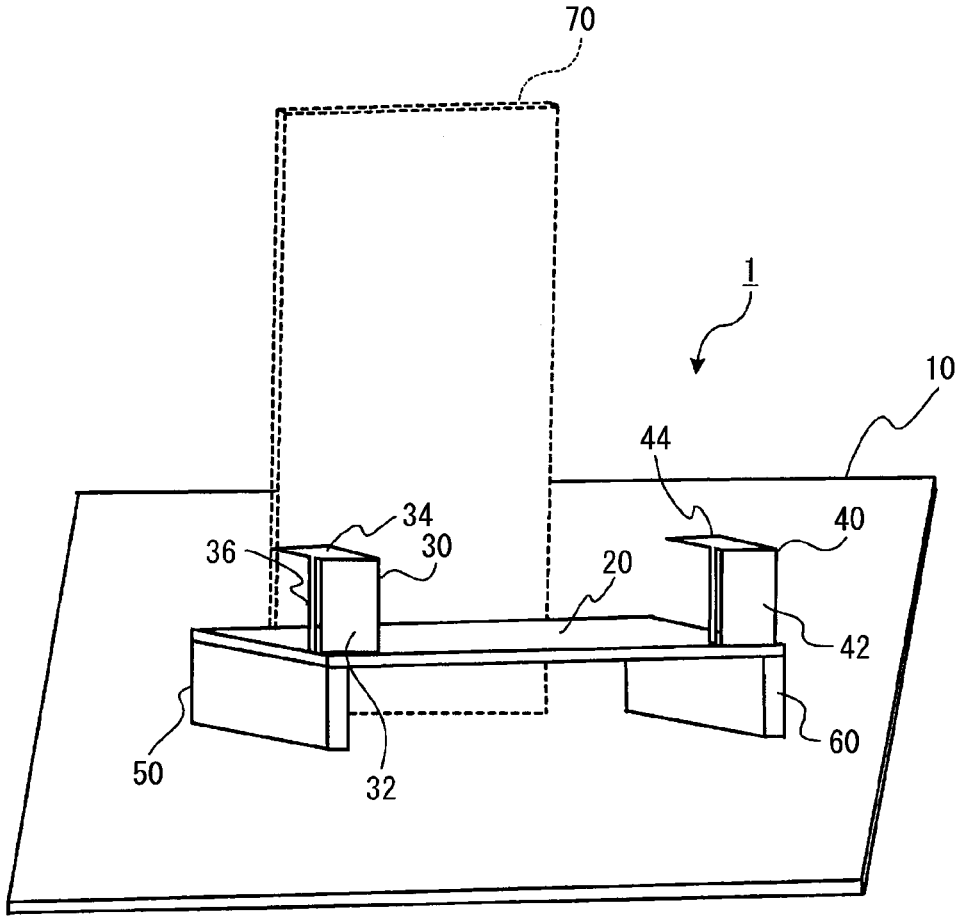
FIG. 1 is a schematic view illustrating an outline configuration of an antenna for wireless apparatus.

FIG. 1 is a schematic view illustrating an outline configuration of an antenna 1 for wireless apparatus. The antenna 1 for wireless apparatus includes a GND plate 10, a printed board 20, antenna elements 30, 40 and raising conductive plates 50, 60, and is placed in the vicinity of a conductive object 70.

The conductive object 70 is a conductor such as a metal structure or the like, for example, a telematics antenna placed on a roof or a hood of a vehicle. That is, in a case where multiple antennas including the antenna 1 for wireless apparatus are assembled into tight space to be compact, an antenna other than the antenna 1 for wireless apparatus is an example of the conductive object 70.

The GND plate 10 is a conductive plate of metal or the like, such as a copperplate or the like which is formed into a substantially rectangular plate shape. The GND plate 10 is grounded to keep its electrical potential at a GND level.

The printed board 20 is formed into a substantially rectangular plate shape. The printed board 20 is placed so that a longer direction of the printed board 20 is parallel to a side surface of the conductive object 70 and so that a plate surface of the printed board 20 is parallel to the GND plate 10. In the printed board 20, a conductive pattern is formed to electrically connect between the two antenna elements 30, 40.

Furthermore, in the printed board 20, a conductive pattern, which is other than the conductive pattern electrically connecting between the two antenna elements 30, 40, may be formed to configure an electronic circuit including a semiconductor integrated circuit chip and electronic parts, in order to cause the antenna 1 for wireless apparatus to operate.

The antenna elements 30, 40 are placed at both ends of the printed board 20 on the farther side from the conductive object 70.

The two antenna elements 30, 40 are inverted-F antennas, a kind of monopole antenna. As shown in FIG. 1, so that the short-circuit conductive bodies 32, 42 are substantially vertical to the plate surface of the printed board 20, the short-circuit conductive bodies 32, 42 are electrically connected to the conductive pattern of the antenna elements on the printed board 20. Furthermore, at tips of the short-circuit conductive bodies 32, 42, radiating plates 34, 44 are attached to be parallel to the printed board 20.

In the configuration, in a case where one piece of a conductive plate is attached to be vertical to the printed board 20 and is bent into L-shaped structure, a vertical portion becomes the short-circuit conductive body 32, 42 and a portion parallel to the GND plate 10 becomes the radiating plate 34, 44.

Then, plate-shaped power supply conductive bodies 36, 46 are attached to the radiating plate 34, 44 of the antenna elements 30, 40 so as to be parallel to the short-circuit conductive body 32, such that tips of plate-shaped power supply conductive bodies 36, 46 do not contact the GND plate 10.

Then, using the tips of the power supply conductive bodies 36, 46 of the antenna elements 30, 40 as feeding points, a 5 GHz transmission signal is fed between the feeding points and the GND plate 10.

Distance between the feeding points of the two antenna elements 30, 40 is greater than a width of the conductive object 70, and distances from the two feeding points of the two antenna elements 30, 40 to the conductive object 70 are less than or equal to a half wavelength of a radio wave to be transmitted and received.

The raising conductive plates 50, 60 are conductive plates formed into substantially a rectangular shape. The raising conductive plates 50, 60 are conductive plates to raise the printed board 20 from the GND plate 10 by 1/16 wavelength or more of the radio wave to be transmitted and received. The two raising conductive plates 50, 60 are attached between the GND plate 10 and the printed board 20, and longer-direction edges of the two raising conductive plates 50, 60 are attached to shorter-direction edges of the printed board 20.

(Operation of Antenna 1 for Wireless Apparatus)

In the antenna 1 for wireless apparatus having the above structure, the printed board 20 as a conductive plate is placed in parallel to the GND plate 10. On the printed board 20, the two antenna elements 30, 40 are placed at an interval of a half wavelength. The printed board 20 is raised from the GND plate 10 by 1/16 wavelength or more by the raising conductive plates 50, 60. Furthermore, the antenna 1 for wireless apparatus is placed in the vicinity of the conductive object 70 so that the two antenna elements 30, 40 become substantially parallel to the side surface of the conductive object 70.

Then, against a transmission signal supplied from the feeding points, a current loop with substantially one wavelength is produced among the GND plate 10, the printed board 20 and the two raising conductive plates 50, 60. That is, a current loop with substantially one wavelength is produced, including a current route which is produced on the printed board 20 between the two antenna elements 30, 40, a current route which is produced on the two raising conductive plates 50, 60, a current route which is produced on the GND plate 10, and a mirror image of the current route.

Since the current loop acts as a new wavelength source, a current distribution of induced current in the conductive object 70 is changed. As a result, since a phase relation of currents which flow at the two antenna elements 30, 40 and the conductive object 70 is changed, a bias of a directivity of a radio wave radiated from the two antenna elements 30, 40 in a same direction is changed and the directivity of the radio wave may be complemented.

Therefore, even when the conductive object 70 is located in the vicinity of the antenna, the antenna can successfully transmit and receive the radio wave in all round directions.

Distance between the two antenna elements 30, 40 is greater than a width of the conductive object 70, and additionally, a distance between each of the feeding points of the two antenna elements 30, 40 and the conductive object 70 is less than or equal to a half wavelength of the radio wave to be transmitted and received.

Therefore, the current more easily flows into the current loop, and thus, the change in the bias of the directivity of the radio wave radiated from the two antenna elements 30, 40 in the same direction is facilitated, and the complementation of the directivity of the radio wave is facilitated.

Figure 2A:
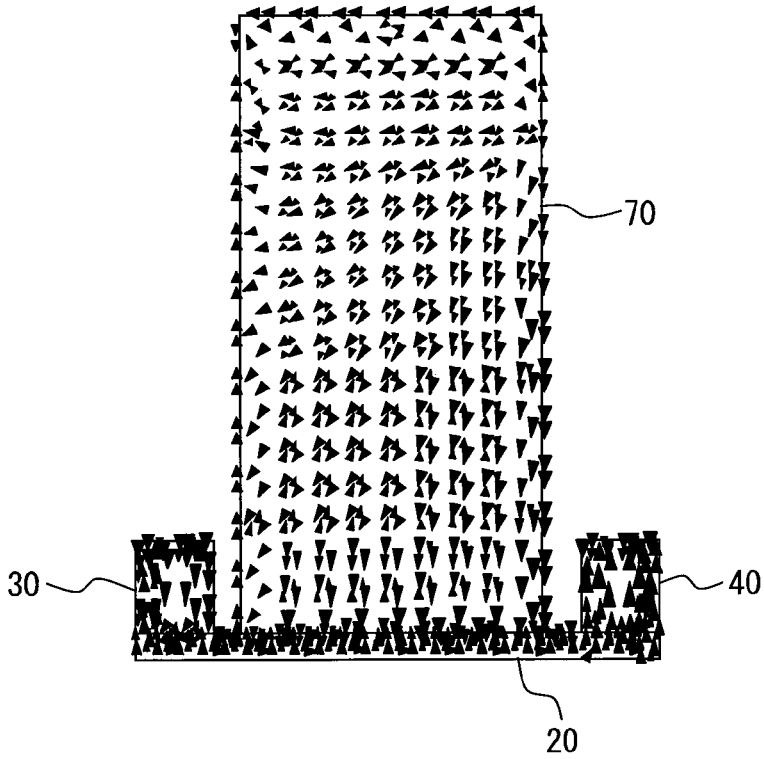
FIG. 2A is a diagram illustrating a simulation result of distribution of a current flow through an antenna element and a conductive object in a comparative example.
Figure 2B:
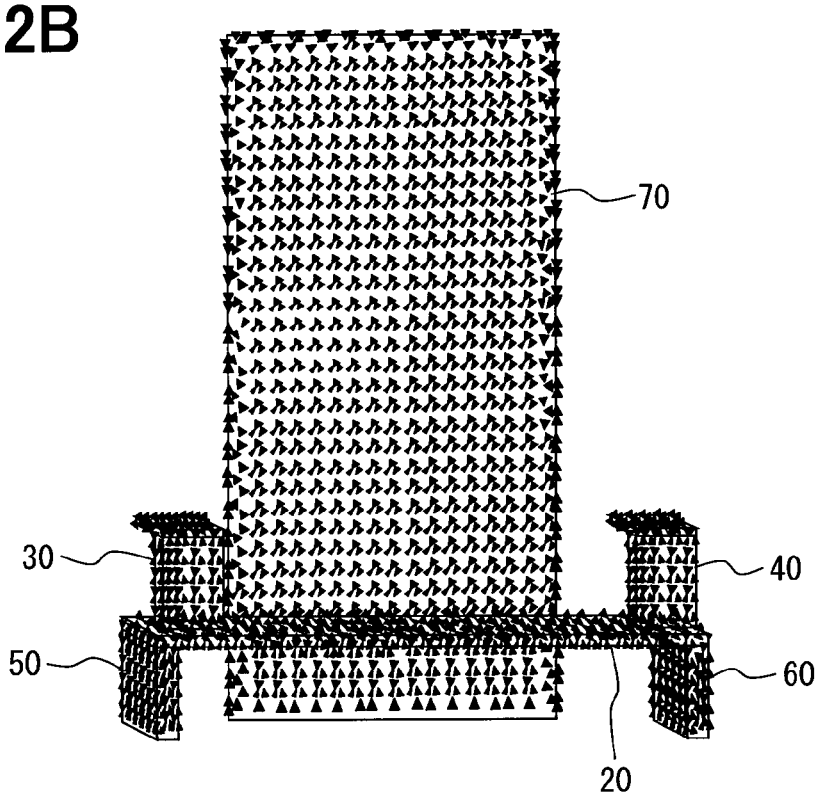
FIG. 2B is a diagram illustrating a simulation result of a distribution of current flow through an antenna element and a conductive object in an embodiment.

This situation is illustrated in FIG. 2A and FIG. 2B. FIG. 2A and FIG. 2B show a simulation result of distribution of current flow through the antenna elements 30, 40 and the conductive object 70 when a 5 GHz transmission signal is applied to the feeding point of the antenna element 40.

In FIG. 2A and FIG. 2B, a current direction is shown by arrows and a sparsity/density of the current distribution is shown by a sparsity/density of arrow distribution. That is, in a part where the arrow distribution is sparse, the current distribution is sparse, and in a part where the arrow distribution is dense, the current distribution is dense.

In a comparative example where the raising conductive plates 50, 60 are not provided, as shown in FIG. 2A, arrow distribution at a lower right of the conductive object 70 is denser than other parts. That is, it is represented that the current distribution at the lower right of the conductive object 70 is dense and that the current distribution in the conductive object 70 is not uniform.

In contrast, in the antenna 1 for wireless apparatus according to the present embodiment, as shown in FIG. 2B, arrows are distributed substantially uniformly in all parts of the conductive object 70. It is represented that the current distribution in the conductive object 70 is uniform.

Figure 3A:
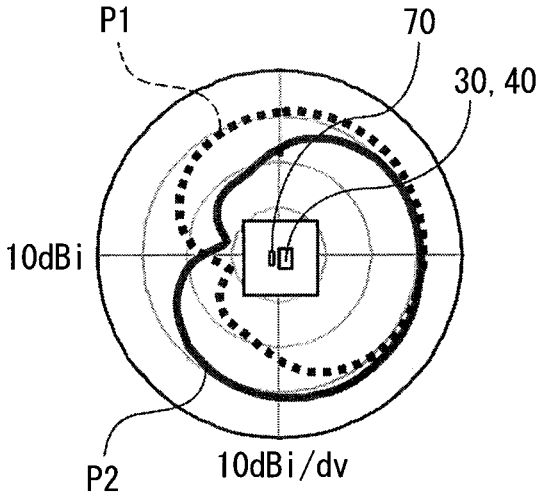
FIG. 3A is a diagram illustrating a directivity of an antenna in the comparative example.
Figure 3B:
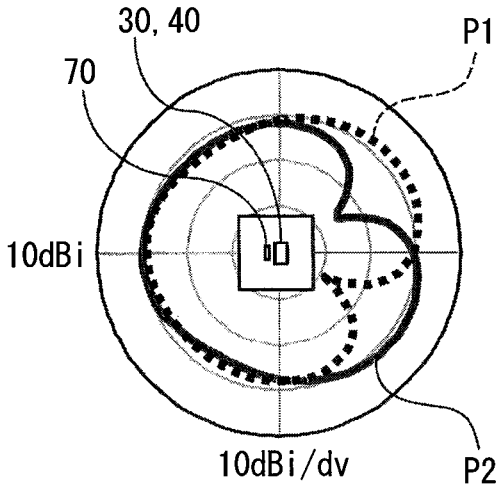
FIG. 3B is a diagram illustrating a directivity of an antenna in an embodiment.

Next, based on FIG. 3A and FIG. 3B, a situation where a directivity is improved by the antenna 1 for wireless apparatus will be described. In a case where a radiated wave has a 5 GHz and a height of the raising conductive plates 50, 60 is set to $\lambda/12$, FIG. 3A and FIG. 3B illustrate a directivity of an antenna in the comparative example and a directivity of the antenna 1 for wireless apparatus in the present embodiment respectively, a directivity being calculated by simulations. "$\lambda$" denotes a wavelength of a radiated wave.

In addition, in the simulations, when the antenna element 30 is simulately supplied with electricity, the feeding point of the antenna element 40 is connected to the conductive pattern of the printed board 20 through a 50Ω terminator.

In FIG. 3A and FIG. 3B, the antenna 1 for wireless apparatus (the antenna elements 30, 40) and the conductive object 70 are placed at the center, a dashed curve line referred to by P1 shown in FIG. 3 denotes a directivity of the antenna element 30, and a dashed curve line referred to by P2 denotes a directivity of the antenna element 40.

FIG. 3A illustrates a directivity of an antenna in the comparative example, and FIG. 3B illustrates a directivity of the antenna 1 for wireless apparatus in the present embodiment.

As shown in FIG. 3A, although the directivity of the antenna in the comparative example is complemented by the directivity P1 of the antenna element 30 and the directivity P2 of the antenna element 40, the directivity in direction to a conductive object 70 is reduced.

In contrast, in the antenna 1 for wireless apparatus in the present embodiment, as shown in FIG. 3B, as a result of complementation with P1 and P2, the directivity in the direction to the conductive object 70 is not reduced. Therefore, compared with the antenna in the comparative example, it is represented that the antenna 1 for wireless apparatus in the present embodiment has a good directivity in all round directions.

Next, based on FIG. 4A through FIG. 4I, a relationship between the height of the raising conductive plates 50, 60 and the directivity will be described. FIG. 4A through FIG. 4I illustrate a relationship between the height of the raising conductive plates 50, 60 and the directivity.

Figure 4A:
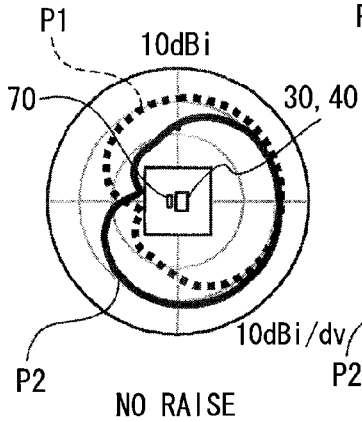
FIG. 4A through FIG. 4I are diagrams illustrating directivities of antennas for wireless apparatus when a distance between raising conductive plates is changed.

FIG. 4A shows a directivity of an antenna (i.e., the antenna in the comparative example) without the raising conductive plates 50, 60. In addition, FIG. 4B through FIG. 4I show the directivity of the antenna 1 for wireless apparatus when the height of the raising conductive plates 50, 60 is set to $\lambda/50$, $\lambda/25$, $\lambda/16$, $\lambda/12$, $\lambda/10$, $\lambda/8$, $\lambda/7$, or $\lambda/6$ against a wavelength $\lambda$ of the radio wave.

Figure 4B:
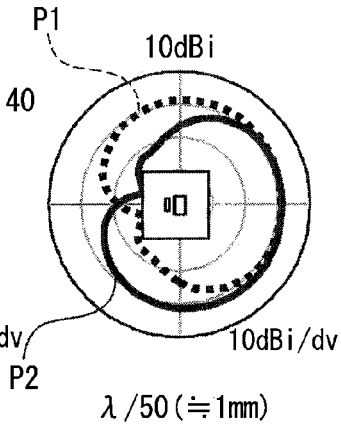
Figure 4C:
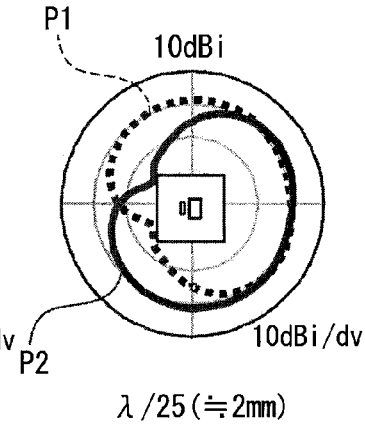
Figure 4D:
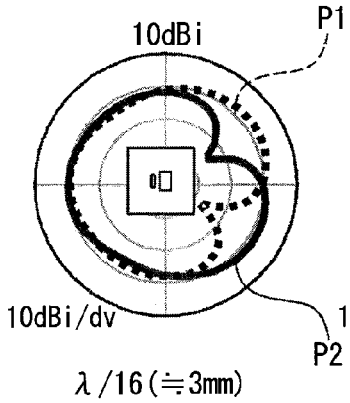
Figure 4E:
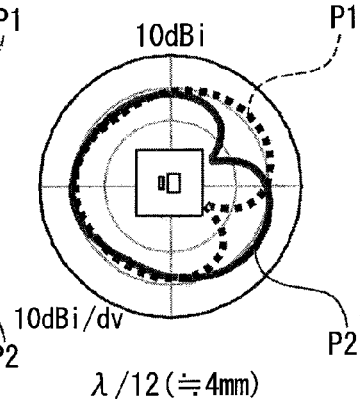
Figure 4F:
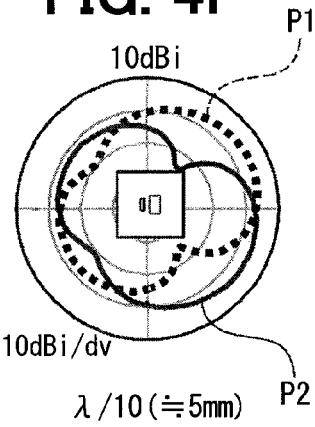
Figure 4G:
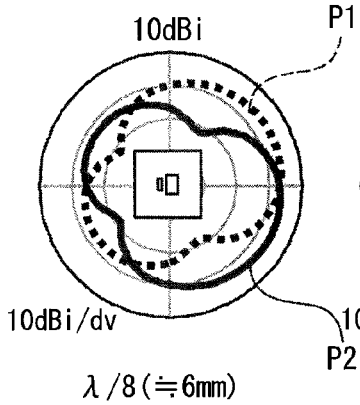
Figure 4H:
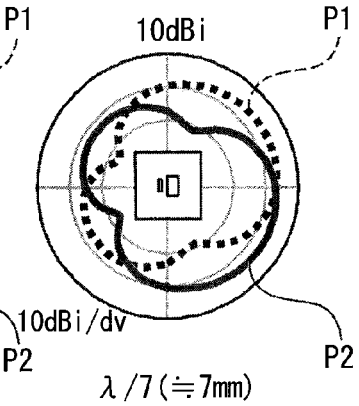
Figure 4I:
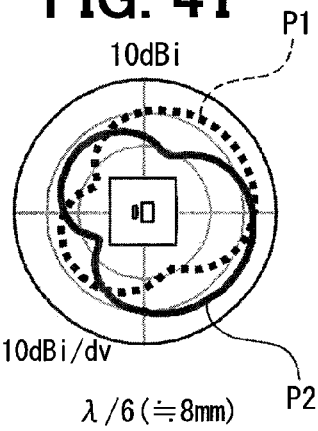
Figure 5A:
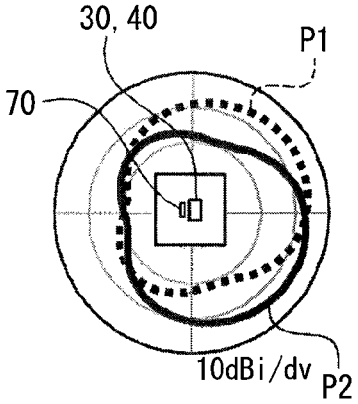
FIG. 5A through FIG. 5H are diagrams illustrating directivities of antennas for wireless apparatus when a length of raising conductive plate is changed.
Figure 5B:
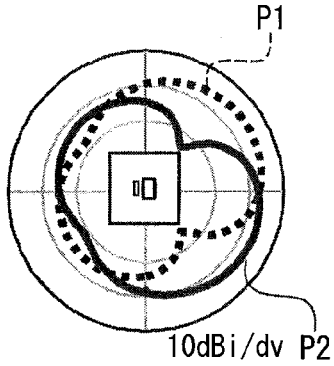
Figure 5C:
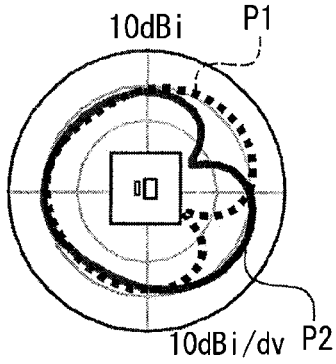
Figure 5D:
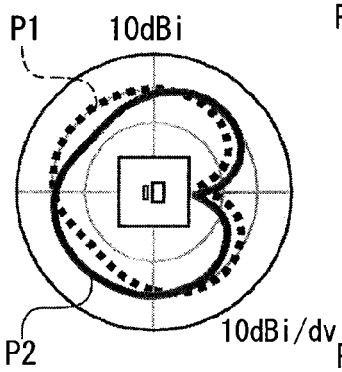
Figure 5E:
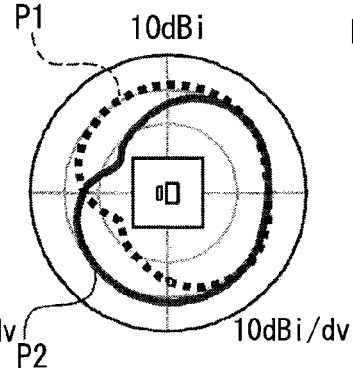
Figure 5F:
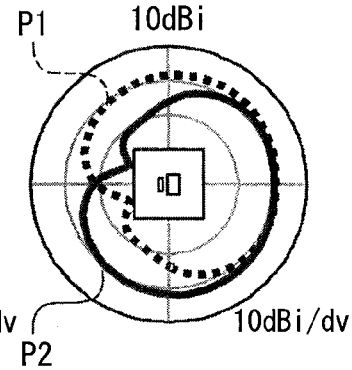
Figure 5G:
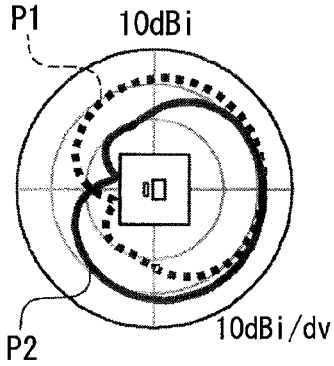
Figure 5H:
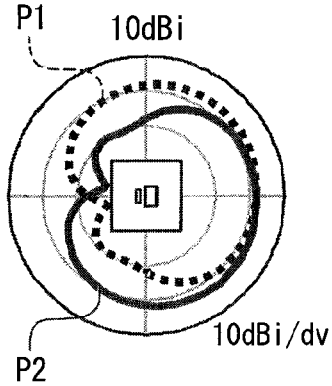

The directivities shown in FIG. 4B and FIG. 4C are not substantially different from a directivity shown in FIG. 4A, and even when P1 and P2 complement each other, there is a portion where the directivity is reduced in the direction to the conductive object 70. In contrast, the directivities shown in FIG. 4D through FIG. 4I are complemented by P1 and P2, and there is no portion where the directivity is reduced in the direction to the conductive object 70. Compared with the directivity shown in FIG. 4A, it is noticeable that a good directivity is obtained in all round directions.

Therefore, when the height of the raising conductive plates 50, 60 is greater than or equal to $\lambda/16$, the directivity is improved in all round directions.

Next, based on FIG. 5A through FIG. 5H, the directivity of the antenna 1 for wireless apparatus in cases where the distance between the raising conductive plates 50, 60 is changed will be described. In FIG. 5A through FIG. 5H, when a 5 GHz radio wave is radiated and when a distance between the raising conductive plates 50, 60 is changed, a directivity of the antenna 1 for wireless apparatus is illustrated.

FIG. 5A through FIG. 5H show directivities of the antenna 1 for wireless apparatus when the distance between the raising conductive plates 50, 60 is set to $\lambda/1$, 9, $\lambda/2$, $\lambda/2.2$, $\lambda/2.4$, $\lambda/2.7$, $\lambda/3.4$ or $\lambda/3.9$. In FIG. 5A through FIG. 5H, the height of the raising conductive plates 50, 60 is set to $\lambda/12$.

As shown in FIG. 5A through FIG. 5H, it is noticeable that, as the distance between the raising conductive plates 50, 60 becomes less than $\lambda/2$, the directivity complemented by P1 and P2 has a directivity reduced portion in the direction to the conductive object 70

Figure 6A:
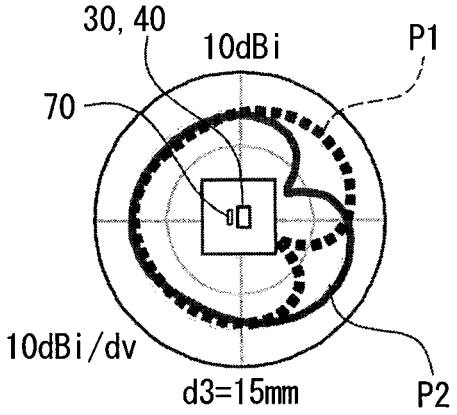
FIG. 6A through FIG. 6C are diagrams illustrating directivities of antennas for wireless apparatus when a length of raising conductive plate is changed.
Figure 6B:
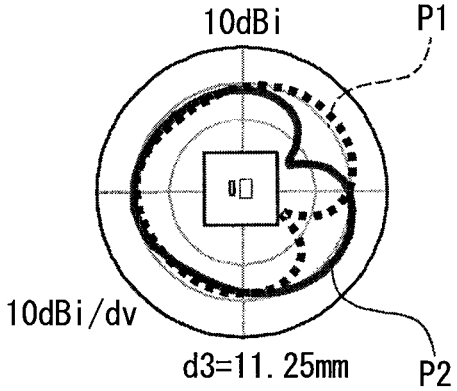
Figure 6C:
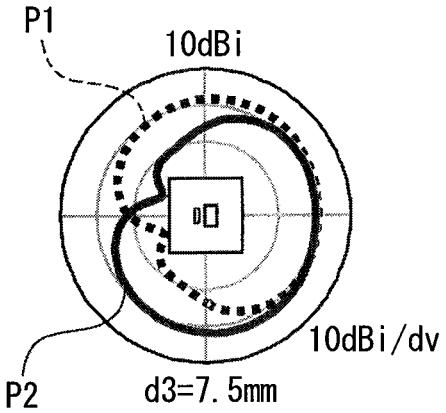

Next, based on FIG. 6A through FIG. 6C, the directivity of the antenna 1 for wireless apparatus in cases where the length of the longer direction of the raising conductive plates 50, 60 is changed will be described. In FIG. 6A through FIG. 6C, when the 5 GHz radio wave is radiated and when the length of the raising conductive plates 50, 60 is changed, the directivity of the antenna 1 for wireless apparatus is illustrated.

FIG. 6A through FIG. 6C show the directivity of the antenna 1 for wireless apparatus when the length of the raising conductive plates 50, 60 is set to 15 mm, 11.25 mm or 7.5 mm.

As shown in FIG. 6A and FIG. 6B, it is noticeable that, when a radiation wavelength is set to 5 GHz and when the length of the raising conductive plates 50, 60 is greater than or equal to 11 mm, the directivity complemented by P1 and P2 has no portion where a directivity is reduced in the direction to the conductive object 70, and a good directivity can be obtained in all round directions.

In addition, since the inverted-F antenna is used as the monopole antenna element 30, 40, the antenna 1 for wireless apparatus in a height direction may be small as compared with other monopole antennas. Therefore, the antenna 1 for wireless apparatus is suitable for a vehicle, especially.

Furthermore, since the printed board 20 formed with the conductive pattern electrically connecting between the two antenna elements 30, 40 is used to make the electric connection, it is possible to place various circuit elements on the printed board 20 to form an electronic circuit by forming a conductive pattern other than the conductive pattern electrically connecting between the two antenna elements 30, 40, and therefore, the antenna 1 for wireless apparatus can be downsized.

Other Embodiment

In the above embodiment, the length of the raising conductive plate 60 is equal to the length of the shorter direction of the printed board 20. However, when the length of the raising conductive plate 60 is greater than or equal to a half length of the shorter direction of the printed board 20, the same performance can be obtained.

In the above embodiment, the inverted-F antenna is used as the antenna elements 30, 40. However, when there is room for installation space of the antenna 1 for wireless apparatus, other monopole antennas such as an inverted-L antenna or the like may be used as the antenna elements 30, 40.

(Aspects)

The antenna for wireless apparatus in the present disclosure can be various aspects. For example, according to an aspect of the present disclosure, there is provided an antenna for wireless apparatus which is placed in the vicinity of the conductive object (70), and which includes a GND plate (10), a conductive plate (20), two antenna elements (30, 40), and two raising conductive plates (50, 60).

The GND plate (10) is a plate-shaped conductive body, and its electric potential is kept at the GND level. The conductive plate (20) is a conductive plate which is placed parallel to the GND plate (10).

Each of the antenna elements (30, 40) is a monopole antenna having the short-circuit conductive body (32, 42) which is placed on the conductive plate (20) in order to electrically connect with the conductive plate (20) and having the radiation plates (34, 44) which is placed at edges of the short-circuit conductive bodies (32, 42) to radiate a radio wave. The two antenna elements (30, 40) are placed substantially parallel to the side surface of the conductive object (70) at an interval of a half wavelength of the radio wave to be transmitted and received.

The two raising conductive plates (50, 60) are placed between the GND plate (10) and the conductive plate (20) and placed close to the two antenna elements (30, 40) respectively. The two raising conductive plates (50, 60) are conductive plates to raise the conductive plate (20) from the GND plate (10) to a predetermined height.

Such the antenna (1) for wireless apparatus is an antenna which can successfully transmit and receive a radio wave in all round directions, even when the conductive object (70) is in the vicinity of the antenna (1) for wireless apparatus. Explanation will be described below.

In the antenna (1) for wireless apparatus having the above configuration, the conductive plate (20) parallel to the GND plate (10) is placed, the two antenna elements (30, 40) are placed on the conductive plate (20) at an interval of a half wavelength, and the conductive plate (20) is raised from the GND plate (10) to a predetermined height by the raising conductive plates (50, 60).

Furthermore, so that the two antenna elements (30, 40) become substantially parallel to the side surface of the conductive object (70), the antenna (1) for wireless apparatus is placed in the vicinity of the conductive object (70).

Then, against a transmission signal supplied from the feeding point, a current loop is produced among the GND plate (10), the conductive plate (20) and the raising conductive plates (50, 60).

That is, the current loop is produced, including a current route which is produced on the conductive plate (20) between the two antenna elements (30, 40) and on the two raising conductive plates (50, 60), and a mirror image produced by the GND plate (10) against the current route is formed.

The current route has twice wavelength of the sum of a first current route and a second current route due to the first current route, the second current route and the mirror image formed by the GND plate (10). The first current route has a half wavelength between the two antenna elements (30, 40) provided on the conductive plate (20) and the second current route is provided by the two raising conductive plates (50, 60).

Since the current loop acts as a new wave source, the current distribution of induced current in the conductive object (70) is changed. As a result, since a phase relation of currents which flow the two antenna elements (30, 40) and the conductive object (70) is changed, the bias of a directivity of the radio wave radiated from the two antenna elements (30, 40) in a same direction is changed and the directivity of the antenna (1) for wireless apparatus will be complemented.

Therefore, even when the conductive object (70) is located in the vicinity of the antenna (1) for wireless apparatus, the antenna (1) for wireless apparatus becomes an antenna which can successfully transmit and receive a radio wave in all round directions.

Herein, "the vicinity of the conductive object (70)" denotes a range where a transmission signal supplied with the antenna elements (30, 40) enables to electrically connect with the conductive element (20), and "the vicinity of each of the two antenna elements (30, 40)" denotes a range where distances between the two antenna elements (30, 40) and the conductive plate (20) correspond to a range where the described current loop can be provided.

As described above, when the conductive plate (20) is raised from the GND plate (10) by the raising conductive plates (50, 60), the current loop is provided and the antenna (1) for wireless apparatus which can successfully transmit and receive a radio wave in all round directions is provided. Especially, when the predetermined height of the raising conductive plates (50, 60) is made greater than or equal to 1/16 wavelength of a radio wave to be transmitted and received, a radio wave in all round directions may be transmitted and received more sufficiently.

Furthermore, the distance between the two antenna elements (30, 40) may be greater than the width of the conductive object (70), and additionally, distances from the two feeding points of the two antenna elements (30, 40) to the conductive object (70) may be less than a half wavelength of the radio wave to be transmitted and received.

According to the configuration, since a current more easily flows into the current loop which is provided as described above, the change in the bias of the directivity of the radio wave radiated from the two antenna elements (30, 40) in the same direction is facilitated and the complementation of the directivity of the radio wave is facilitated.

Incidentally, in monopole antenna elements (30, 40), there are various kinds of antennas such as a monopole antenna, an L-shaped antenna or the like. For example, monopole antenna elements (30, 40) may be inverted-F antennas. According to the configuration, the antenna (1) for wireless apparatus in a height direction may be small as compared with other monopole antennas. Therefore, the antenna (1) for wireless apparatus which is especially suitable for use in a vehicle can be provided.

Furthermore, the conductive plate (20) may be a printed board formed with at least a conductive pattern that electrically connects between the two antenna elements (30, 40). According to the configuration, since it is possible to place various circuit elements on the printed board 20 to form an electronic circuit by forming a conductive pattern other than the conductive pattern electrically connecting between the two antenna elements (30, 40), the antenna (1) for wireless apparatus can be downsized.

Furthermore, the present disclosure is not limited to the above described embodiments and constructions, and includes various modifications. In addition, other various combinations and embodiments, only including more or less a single element, are also within the scope of the present disclosure.

The invention claimed is:

1. An antenna for wireless apparatus placed in vicinity of a conductive object, comprising:

a GND plate that is a conductive body formed into a plate shape and has an electric potential kept at a GND level;

a conductive plate that is placed parallel to the GND plate;

two antenna elements; and two raising conductive plates, wherein:

each of the two antenna elements is a monopole antenna element including a short-circuit conductive body placed on the conductive plate, so that the short-circuit conductive body is electrically connected with the conductive plate, and a radiating plate for radiating a radio wave, the radiating plate being placed at an edge of the short-circuit conductive body;

the two antenna elements are placed substantially parallel to a side surface of the conductive object, and are arranged at an interval of a half wavelength of the radio wave to be transmitted and received; and the two raising conductive plates are placed between the GND plate and the conducting plate, are respectively placed close to the two antenna elements, and raise the conductive plate from the GND plate to a predetermined height.

2. The antenna for wireless apparatus according to claim 1, wherein the predetermined height raised by the two raising conductive plates is greater than or equal to 1/16 wavelength of the radio wave to be transmitted and received.

3. The antenna for wireless apparatus according to claim 1, wherein a distance between the two antenna elements is greater than a width of the conductive object, and the two antenna elements are placed so that distances from the two feeding points of the two antenna elements to the conductive object are less than or equal to the half wavelength of the radio wave to be transmitted and received.

4. The antenna for wireless apparatus according to claim 1, wherein each of the monopole antenna elements is an inverted-F antenna.

5. The antenna for wireless apparatus according to claim 1, wherein the conductive plate is a printed board formed with at least a conductive pattern that electrically connects between the two antenna elements.

* * * * *